US009359862B2

(12) United States Patent
Huh et al.

(10) Patent No.: US 9,359,862 B2
(45) Date of Patent: Jun. 7, 2016

(54) WELLBORE ISOLATION WHILE PLACING VALVES ON PRODUCTION

(71) Applicant: Schlumberger Technology Corporation, Sugar Land, TX (US)

(72) Inventors: Michael Huh, Pearland, TX (US); Josh Belleville, Katy, TX (US); Jessica Schulte, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 625 days.

(21) Appl. No.: 13/720,798

(22) Filed: Dec. 19, 2012

(65) Prior Publication Data

US 2013/0319658 A1 Dec. 5, 2013

Related U.S. Application Data

(60) Provisional application No. 61/654,976, filed on Jun. 4, 2012.

(51) Int. Cl.

| | |
|---|---|
| ***E21B 33/12*** | (2006.01) |
| ***E21B 33/13*** | (2006.01) |
| ***E21B 34/06*** | (2006.01) |
| ***E21B 34/14*** | (2006.01) |
| ***E21B 43/02*** | (2006.01) |

(52) U.S. Cl.

CPC ..... *E21B 33/13* (2013.01); *E21B 33/12* (2013.01); *E21B 34/06* (2013.01); *E21B 34/14* (2013.01); *E21B 43/02* (2013.01)

(58) Field of Classification Search

CPC ..... E21B 34/14

See application file for complete search history.

(56) References Cited

U.S. PATENT DOCUMENTS

| | | | | |
|---|---|---|---|---|
| 3,768,556 | A | 10/1973 | Baker | |
| 3,789,926 | A | 2/1974 | Henley et al. | |
| 4,949,788 | A | 8/1990 | Szarka et al. | |
| 4,991,653 | A | 2/1991 | Schwegman | |
| 4,991,654 | A | 2/1991 | Brandell et al. | |
| 6,776,238 | B2 | 8/2004 | Dusterhoft et al. | |
| 7,108,067 | B2 | 9/2006 | Themig et al. | |
| 7,267,172 | B2 | 9/2007 | Hofman | |
| 7,387,165 | B2 | 6/2008 | Lopez de Cardenas et al. | |
| 7,431,091 | B2 | 10/2008 | Themig et al. | |
| 8,857,518 | B1 * | 10/2014 | Tips | E21B 33/124 166/313 |
| 2007/0272411 | A1 | 11/2007 | Lopez de Cardenas et al. | |
| 2009/0044944 | A1 * | 2/2009 | Murray | E21B 43/02 166/308.1 |
| 2009/0084553 | A1 | 4/2009 | Rytlewski et al. | |

(Continued)

OTHER PUBLICATIONS

Jasek, S., and Poizat, J., "Selective Shifting Tool", Published IP.com, Publication Identifier IPCOM000205886D, Apr. 6, 2011; pp. 1-3.

(Continued)

*Primary Examiner* — Robert E Fuller
*Assistant Examiner* — Steven MacDonald
(74) *Attorney, Agent, or Firm* — Jeffery R. Peterson

(57) ABSTRACT

An internal completion string is anchored within a closed casing valve of a production liner in a wellbore. The internal completion string comprises a packer and a shifting tool. The production liner comprises a casing valve having a port and a moveable member. The annulus defined between the production liner and the internal completion string is sealed, and the shifting tool is remotely operated to move the moveable member away from the port, thereby opening the casing valve.

9 Claims, 6 Drawing Sheets

(56) References Cited

U.S. PATENT DOCUMENTS

| | | | | |
|---|---|---|---|---|
| 2009/0139726 | A1 | 6/2009 | Gomez | |
| 2009/0260835 | A1* | 10/2009 | Malone | E21B 43/08 166/387 |
| 2011/0056692 | A1 | 3/2011 | Lopez de Cardenas et al. | |
| 2011/0120726 | A1 | 5/2011 | Murray et al. | |
| 2011/0214884 | A1 | 9/2011 | Faanes et al. | |
| 2012/0048559 | A1 | 3/2012 | Ganguly et al. | |
| 2012/0080190 | A1 | 4/2012 | Rytlewski | |
| 2012/0325466 | A1* | 12/2012 | Themig | E21B 47/09 166/255.2 |
| 2013/0014953 | A1* | 1/2013 | Van Petegem | E21B 34/14 166/308.2 |
| 2013/0062066 | A1* | 3/2013 | Broussard | E21B 34/06 166/305.1 |
| 2013/0319687 | A1* | 12/2013 | Huh | E21B 34/14 166/381 |

OTHER PUBLICATIONS

International Search Report and Written Opinion of PCT Application No. PCT/US2013/040839 dated Aug. 20, 2013: pp. 1-14.

* cited by examiner

WELLBORE ISOLATION WHILE PLACING VALVES ON PRODUCTION

CROSS-REFERENCE TO RELATED APPLICATIONS

This application claims the benefit of U.S. Provisional Application No. 61/654,976, entitled "METHOD OF RETAINING WELLBORE ISOLATION WHILE PLACING VALVES ON PRODUCTION," filed Jun. 4, 2012, the entire disclosure of which is hereby incorporated herein by reference.

BACKGROUND OF THE DISCLOSURE

In the typical well that is treated by conventional sand control processes, the production liner is first perforated and then a sand control completion system is run in the hole. The sand control system comprises of a fluid barrier device such as a ball valve or flapper valve that closes when the treating string is removed from the wellbore after the treatment is performed. The well barrier device provides isolation for the wellbore from the formation, and allows for other operations to be performed in the wellbore prior to producing. Wellbore operations prior to production are performed above the fluid barrier device. For example, production tubing can be run in the hole and, once properly sealed, the fluid barrier device is opened mechanically and the well is produced.

However, the production liner may comprise of a series of casing valves. The casing valves have a sleeve for isolating a port that allows fluids to flow between the wellbore and the formation. Typically, the casing valves are cemented in the open hole and the sleeves are moved away from the port, thus providing access to the formation. The casing valves are opened so that treating of the formation can be performed. The treating may comprise pumping slurry to fracture the formation. The sleeves are positioned by mechanical methods, such as collets or key type shifting tools attached to a work string. The work string is moved up and down to position the sleeve. The casing valves can be left open after the treatment. To provide wellbore isolation from the formation, a fluid barrier device can be placed above the top-most casing valve of the production liner. When the treating string is removed, the fluid barrier device is closed, and the wellbore above the production liner is isolated from the formation. The wellbore in the production liner is exposed to the formation, however, and access below the fluid barrier is prevented.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
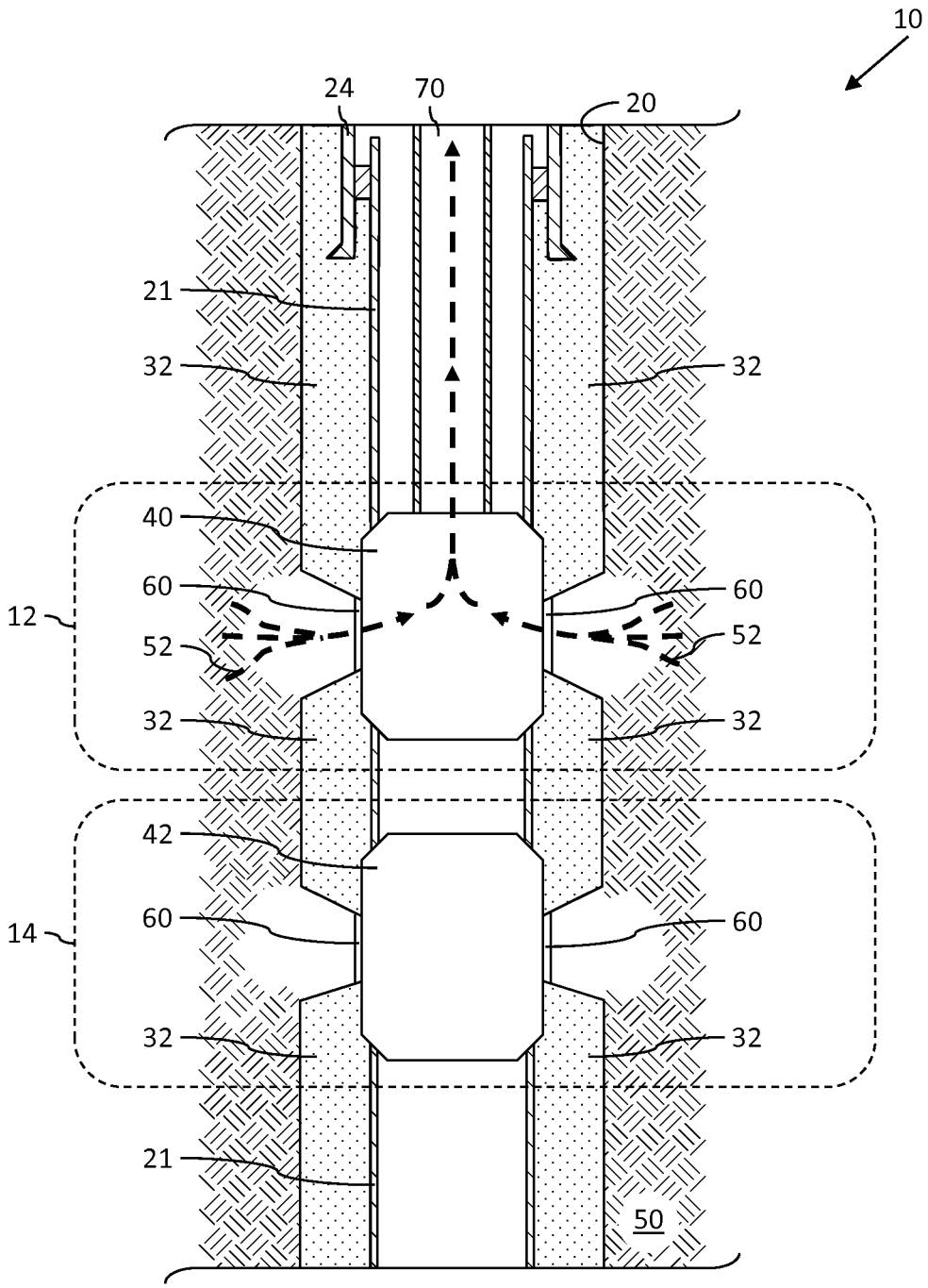
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and may or may not in itself dictate a relationship between the various embodiments and/or configurations discussed herein.

FIG. 1 is a schematic view of a system 10 according to one or more aspects of the present disclosure. The system 10 may be one of several environments in which one or more aspects of one or more apparatus may be implemented within the scope of the present disclosure, and/or in which one or more aspects of one or more methods may be executed within the scope of the present disclosure. Thus, while the system 10 is described in detail herein and other aspects of the present disclosure and figures may be described below in the context of the system 10 shown in FIG. 1, other systems not identical to the system 10 shown in FIG. 1 are also within the scope of the present disclosure.

The system 10 may be used to selectively stimulate one or more well zones 12 and 14 of a subterranean formation 50 intersected by a wellbore 20. In FIG. 1, two well zones 12 and 14 are depicted, and the wellbore 20 is substantially vertical as it extends through the well zones 12 and 14. However, any number of well zones may exist, and the wellbore 20 may be horizontal or inclined in any direction when extending through the well zones, and such scenarios are within the scope of the present disclosure.

A production liner 21 is installed in the wellbore 20. As used herein, the term "production liner" indicates any casing, tubular and/or string of tubulars used, for example, to form a protective lining for the wellbore 20. Furthermore, the production liner 21 may extend to the top of the wellbore 20 or may be anchored or suspended from inside the bottom of a previous casing string. In FIG. 1, the production liner 21 is connected to a liner hanger 24, which connects to a previous casing string (not shown). The production liner 21 may be made of any material, such as steel, polymers or composite materials, among others, and may be jointed, segmented or continuous.

The production liner 21 may be sealed to the surrounding formation 50 using cement, epoxy and/or other hardenable materials 32 (collectively referred to herein as cement 32), and/or using packers or other sealing materials, to prevent or isolate axial (relative to the axis or centerline of the wellbore 20) fluid communication through an annulus formed between the production liner 21 and the wellbore 20. As used herein, the term "cement" indicates a hardenable sealing substance which is initially sufficiently fluid to flow into a cavity in a wellbore, but which subsequently hardens or "sets up" so that it seals off the cavity. Some cement within the scope of the present disclosure may harden when hydrated. Other types of cement within the scope of the present disclosure (e.g., epoxies and/or other polymers) may harden due to passage of time, application of heat and/or a combination of certain chemical components, among other methods. Although FIG. 1 depicts cement 32 between the production liner 21 and the wellbore 20, the apparatus and methods described herein may be utilized without the use of cement 32 between the production liner 21 and the wellbore 20.

The production liner 21 depicted in FIG. 1 comprises two casing valves 40 and 42 interconnected therein. It should be understood that the production liner 21 may comprise fewer or more than two casing valves, and the casing valves may be axially spaced apart at regular or irregular intervals along the production liner 21. The casing valves 40 and 42 may each be integrally formed with a portion of the production liner 21 or may be connected to the production liner 21 via threaded coupling and/or other means. As also shown in FIG. 1, each of the casing valves 40 and 42 correspond to the well zones 12 and 14, respectively, and the production liner 21 is positioned in the wellbore 20 such that the casing valves 40 and 42 are adjacent, opposite or otherwise proximate the corresponding well zones 12 and 14. However, it should be understood that any number of casing valves may be utilized with each zone within the scope of the present disclosure, and it is not mandatory that a single casing valve correspond to a single well zone. For example, multiple casing valves could correspond to, and thus be positioned adjacent or proximate to, a single well zone, and a single casing valve could correspond to, and be positioned opposite, multiple well zones.

An internal completion string 70 may be landed in the wellbore 20 within the production liner 21 in a manner permitting one or more features of the internal completion string 70 to selectively open and/or close the casing valves 40 and 42. A sealbore (not shown) may be disposed between the casing valve 40 and a seal of the internal completion string 70, such as to isolate the casing valves 40 and 42 from one another and/or to isolate the well zones 12 and 14 from one another. One or more sealbores may also be utilized to isolate the well zones 12 and 14 from one another when a plurality of casing valves are present for one or more of the respective well zones 12 and 14.

Each of the casing valves 40 and 42 is selectively operable to permit and prevent fluid flow between an interior and exterior of the production liner 21. The casing valves 40 and 42 may also control flow between the interior and exterior of the production liner 21 by variably choking or otherwise regulating such flow.

With the casing valves 40 and 42 positioned adjacent or proximate the respective well zones 12 and 14 as depicted in FIG. 1, the casing valves 40 and 42 may also be configured downhole, according to one or more aspects of the present disclosure, to selectively control flow between the interior of the production liner 21 and each of the well zones 12 and 14. For example, the casing valves 40 and 42 may be configured to selectively extract formation fluid 52 from one or more particular well zones 12 and/or 14 into the production liner 21 and uphole to the Earth's surface.

Similarly, each of the well zones 12 and 14 may be selectively stimulated by flowing treatment fluid (not shown) through the production liner 21 and through any of the open casing valves into the corresponding well zones. In this way, one or more casing valves 40 and/or 42 may be opened to selectively treat (e.g., stimulate by fracturing, acidizing and/or other means) one or more particular well zones 12 and/or 14 without affecting the remaining well zones. For example, the cement 32 may prevent treatment fluid from flowing through the annulus between the production liner 21 and the wellbore 20 into adjacent well zones in which treatment is not desired.

As used herein, the term "treatment fluid" indicates any fluid or combination of fluids injected into the formation 50 or well zone 12 and/or 14 to increase a rate of fluid flow through the formation 50 or well zone 12 and/or 14. For example, a treatment fluid might be used to fracture the formation 50, to deliver proppant to fractures in the formation, to acidize the formation, to heat the formation, and/or to otherwise increase the mobility of fluid in the formation. Treatment fluid may include various components, including gels, proppants and breakers, among others. The fluid may also or alternatively be or comprise some type of treatment fluid other than stimulation fluid.

Each of the casing valves 40 and 42 has one or more ports 60 for providing fluid communication through a sidewall of the casing valve 40 or 42. It is contemplated that the cement 32 may prevent flow between the ports 60 and the well zones 12 and 14 after the cement 32 has hardened, such that various measures may be employed to either prevent the cement 32 from blocking this flow or to remove the cement 32 from the ports 60 and from between the ports 60 and the well zones 12 and 14. For example, the cement 32 may be a soluble cement (such as an acid soluble cement), and the cement in the ports 60 and between the ports 60 and the well zones 12 and 14 may be dissolved by a suitable solvent to permit the treatment fluid to flow into the well zones 12 and 14. Treatment fluid may also or alternatively be such a solvent, perhaps in lieu of introducing any other solvent.

One or more casing valves 40 and/or 42 may be sequentially or substantially simultaneously opened to permit the extraction of formation fluids 51 from well zones 12 and/or 14 substantially together or one at a time, perhaps in a particular order. Similarly, one or more well zones 12 and/or 14 may be treated sequentially or substantially simultaneously by opening the casing valves 40 and/or 42 substantially together or one at a time, perhaps in a particular order.

The casing valves 40 and 42 may also be utilized to control the rate of production from each well zone 12 and 14. For example, if the well zone 12 should begin to produce water, the corresponding casing valve 40 could be closed, or flow through the casing valve 40 could be choked to reduce the production of water. If the well is an injection well, the casing valves 40 and 42 may be useful to control placement of an injected fluid (e.g., water, gas, steam, etc.) into the corresponding well zones 12 and 14. A waterflood, steamfront, oil-gas interface and/or other injection profile may be manipulated by controlling the opening, closing or choking of fluid flow through the casing valves 40 and 42.

One skilled in the art may appreciate other ways in which casing valves may be selectively opened, closed or choked to accomplish other downhole tasks. Such methods and tasks may also be within the scope of the present disclosure.

Figure 2:
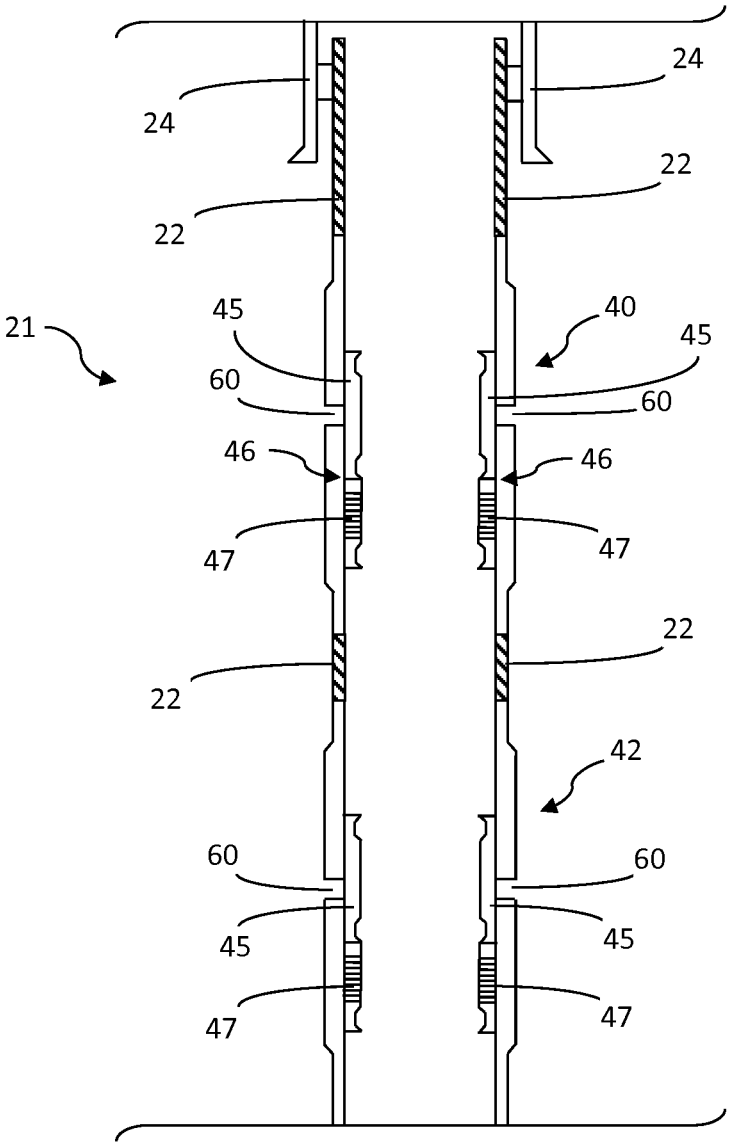
FIG. 2 is a schematic view of at least a portion of apparatus according to one or more aspects of the present disclosure.

FIG. 2 is a schematic view of the production liner 21 according to one or more aspects of the present disclosure, but with several features removed for clarity of illustration. The production liner 21 comprises tubing 22 connecting two or more casing valves 40 and 42. The tubing 22 may be or comprise any casing, tubular and/or other string of tubulars utilized to form a protective lining for the wellbore 20, for example, such that the production liner 21 may be or comprise an outer subsystem that may protect the wellbore, isolate a section of the wellbore, and/or permit the flow of fluids into or out of the formation through the one or more casing valves 40 and 42. The tubing 22 may extend to the top of the wellbore or may be anchored or suspended from inside the bottom of a previous casing string. In FIG. 2, the tubing 22 is connected to a liner hanger 24, which couples the tubing 22 to a casing (not shown) extending along a substantial portion of the wellbore 20. The tubing 22 may be made of any material, such as steel, polymers or composite materials, among others, and may be jointed, segmented or continuous. As described for FIG. 1, the production liner 21 may or may not be rigidly fixed to the walls of the wellbore, although it should be understood that the production liner might be substantially stationary during fluid transfer operations.

The casing valves 40 and 42 each comprise one or more moveable members 46, each of which may comprise one or more sleeves 45 and/or filter elements 47. For example, a moveable member 46 that is a substantially solid and/or other annular sleeve may be positioned relative to a corresponding port 60 such that fluid flow through the port 60 is prevented, and a moveable member 46 that is a filter element 47 may filter fluid flow through the port 60. The filter elements 47 may, for example, comprise a wire mesh with openings properly spaced so as to limit particles of a certain size from entering the ports 60 during fluid flow. However, other types of filter elements 47 may also or alternatively be utilized for this and/or other purposes within the scope of the present disclosure. The methods and apparatus herein disclosed may alternatively be implemented with one or more moveable members 46 that comprise one of the sleeve 45 and filter element 47 but not the other. One or more of the moveable members 46 may comprise the sleeve 45 and the filter element 47 integrally formed as a single, discrete moveable member. One or more of the moveable members 46 may also or alternatively comprise the sleeve 45 and the filter element 47 as discrete moveable members abutting one another and moveable independently or as a unit.

As described below, the moveable members 46 may be actuated so as to open or close corresponding ports 60 of the casing valves 40 and 42 by means of a shifting tool within an internal completion string that may be positioned at a particular depth within the production liner 21. The internal completion string may be operable to cause the moveable members 46 to slide relative to the ports 60 via linear actuation or via rotational/torque actuation, for example.

Figure 3:
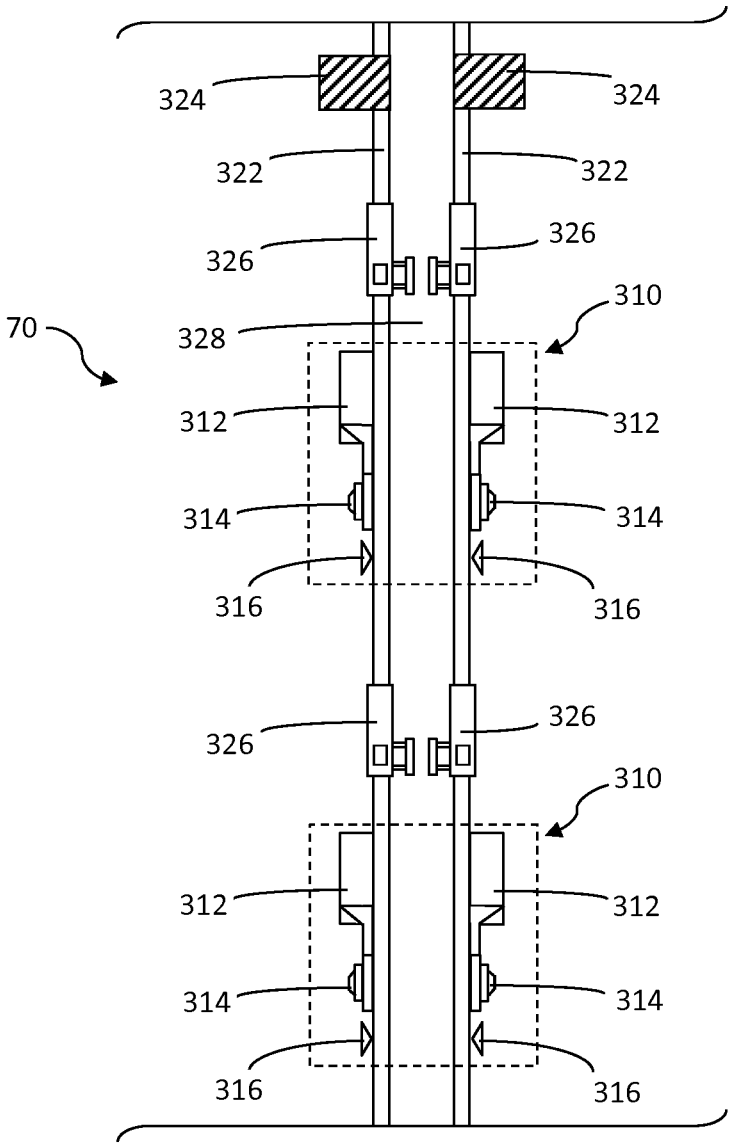
FIG. 3 is a schematic view of at least a portion of apparatus according to one or more aspects of the present disclosure.

FIG. 3 is a schematic view of an example of one such internal completion string 70 according to one or more aspects of the present disclosure. The internal completion string 70 may be conveyed to a particular depth within the production liner 21 shown in FIG. 2. The internal completion string 70 may comprise tubing 322, packers 324, an internal flow passage 328, and a series of flow control valves 326 and shifting tools 310.

Referring to FIGS. 2 and 3 collectively, the shifting tools 310 are spaced along the internal completion string 70 at distances appropriate to interface with the valves 60 of the production liner 21. Packers 324 that may be positioned at the top of the internal completion string 70 may be inflated to isolate an interval of the wellbore.

As best shown in FIG. 3, each shifting tool 310 may comprise one or more expandable anchors 316 which, for example, may stabilize the internal completion string 70 relative to the production liner 21. Each shifting tool 310 may also comprise one or more interface members 314 that each selectively engage a corresponding moveable member 46 of a casing valve 40/42. Each shifting tool 310 may also comprise one or more actuators 312 operable to axially translate a corresponding one of the moveable members 46.

As best illustrated in FIG. 3, the interface members 314 may each be or comprise a collet, and each collet and corresponding moveable member 46 may comprise profiles that are collectively cooperative to engage and mate with each other. However, other mechanisms may also or alternatively be utilized to achieve the desired interaction between the interface members 314 and the moveable members 46. For example, such alternate engagement mechanisms might include key or dog mechanisms, which might be spring-loaded or hydraulically actuated into engagement. Alternatively, or additionally, one or more of the interface members 314 may incorporate a set of slips that bite into the moveable members 46 instead of latching into their profile. These and other alternate mechanisms to engage the moveable members 46 to open or close the casing valves 60 are also considered to be within the scope of the present disclosure.

The actuators 312 may each comprise a piston within a cylinder and/or other mechanism configured to impart linear motion to the moveable members 46 in a direction substantially parallel to the longitudinal axis of the borehole. However, other mechanisms may alternatively be employed to impart motion to the moveable members 46, such as where the moveable members 46 may be actuated via rotation instead of linear motion (e.g., one or more of the actuators 312 may be a rotating/torque actuator instead of a linear actuator). These and other alternate mechanisms to impart linear motion to the moveable members 46 to open or close the casing valves 60 are also considered to be within the scope of the present disclosure.

The flow control valves 326 may be configured to permit or prevent fluid from flowing through a section of the internal passage 71 of the internal completion string 70. For example, after all the casing valves 60 are shifted to the production mode, the flow control valves 326 may be opened to allow the flow of formation fluids to the Earth's surface.

Figure 4:
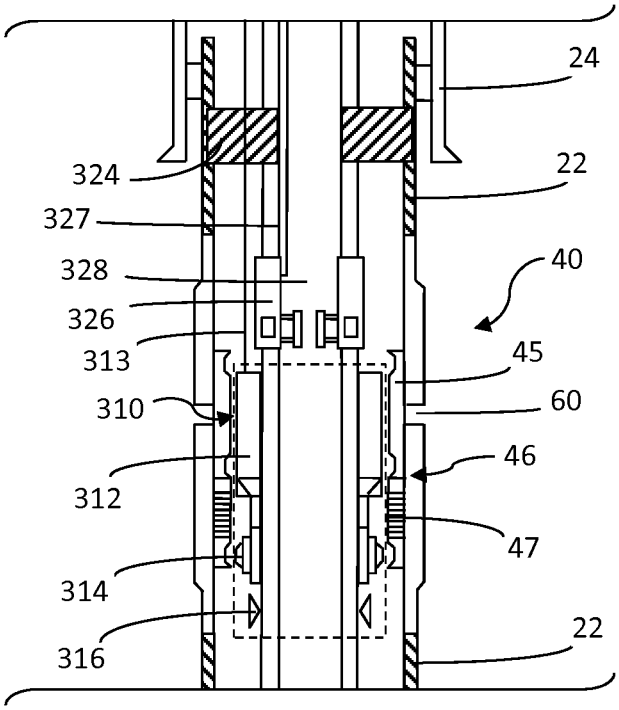
FIG. 4 is a schematic view of at least a portion of apparatus according to one or more aspects of the present disclosure.
Figure 5:
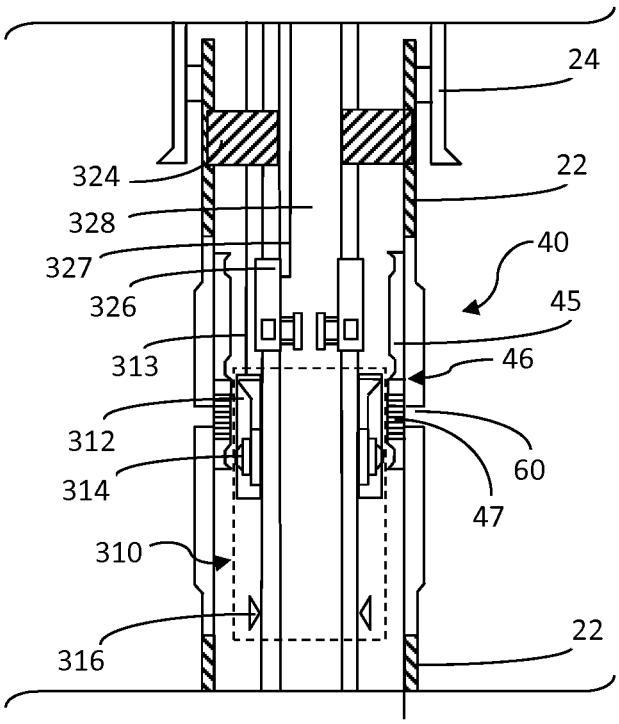
FIG. 5 is a schematic view of at least a portion of apparatus according to one or more aspects of the present disclosure.

FIGS. 4 and 5 are schematic views of a portion of the system 10 shown in FIG. 1 in which the casing valve 40 is intersected by the internal completion string 70. FIG. 4 depicts the casing valve 40 in a closed configuration, and FIG. 5 depicts the casing valve 40 in an open configuration.

After the internal completion string 70 is appropriately positioned relative to the production liner 21, the packers 324 located above the flow control valves 326 may be inflated to form a seal between the internal completion string 70 and the tubing 22. The anchors 316 may also be expanded to stabilize the internal completion string 70 relative to the casing valve 40.

Thereafter, a signal may be transmitted remotely from the Earth's surface through a shifting tool actuator control line 313 to operate the actuator 312 of the shifting tool 310. Such operation causes linear displacement of the interface members 314 sufficient to cause the interface members 314 to engage and mate with the movable members 46 of the casing valve 40. The linear motion of the interface members 314 is also sufficient to move the moveable members 46 in front of or away from the ports 60 of the casing valve 40. For example, to open the ports 60 of the casing valve 40, operation of the shifting tool 310 may cause the sleeves 45 to move away from the ports 60 and, substantially simultaneously, cause the filter elements 47 to move towards the port. Similarly, if the actuator 312 is remotely operated to produce linear displacement in the opposite direction, the filter elements 47 and sleeves 45 may be moved so as to bring the filter elements 47 away from the ports 60, and to bring the ports 60 and the sleeves 45 into contact with and thus closing the ports 60. Operating the actuators 312 to move the moveable members 46 to open or close the ports 60 of the casing valve 40 may permit or prevent, respectively, pressurized fluid from being communicated between the internal completion string 70 and the subterranean formation. The anchors 316 may optionally be retracted after shifting. The process may then be repeated to open or close other casing valves without mechanically moving the internal completion string 70.

In the example configuration shown in FIGS. 4 and 5, the actuator 312 is configured such that the casing valve 40 is opened when the shifting tool 310 strokes in an upward direction (i.e., away from the bottom end of the wellbore 20). However, it should be appreciated that the mechanical components could be arranged differently such that the shifting may occur downward to open the casing valve 40 (i.e., the moveable members 46 may be shifted down instead of up to open the valve 40). As described above, other mechanisms such as rotational actuators may also be used to slide the moveable members 46 to open or close the casing valve 40.

There are numerous methods to remotely transmit the signal through the shifting tool actuator control line 313 to selectively operate the actuators 312 and/or anchors 316 of the shifting tool 310. For example, the actuator control line 313 may be or comprise one or more electric and/or hydraulic lines extending from the Earth's surface to the shifting tool 310. Where the actuator control line 313 is configured to transmit an electronic signal, the path traveled by the signal from surface may include an inductive coupling. Where the actuator control line 313 is configured to transmit a hydraulic signal, the signal may be at least partially carried by fluid flow within the internal completion string 70, including in implementations in which fluid flow within the internal flow passage 328 may be at least partially controlled by the flow control valve 326 and/or other flow control valves in fluid communication with the internal flow passage 328 of the internal completion string 70. Transmitting the signal from surface may also comprise forming a hydraulic wet mating to actuate the shifting tool 310. Where the actuator control line 313 is configured to transmit a hydraulic signal, fluid from surface carrying the signal may also or alternatively be received by the shifting tool 310 and converted into a radio-frequency identification (RFID) signal which may actuate the actuator 312 and/or anchors 316. In another approach, the shifting tool 310 may be remotely operated by transmitting a hydraulic signal by flowing fluid from surface equipment through the internal flow passage 328 of the internal completion string 70 to an intelligent valve (IRDV), which comprises a controller that can detect the hydraulic pulses and interpret them as commands to be carried out using hydrostatic pressure available downhole. In another approach, fluid may be flowed through the internal flow passage 328 of the internal completion string 70 such that a ball may be conveyed via the fluid to a landing in the internal completion string 70. The ball drop may signal the actuator 312 and/or anchors 316. In yet another approach, the shifting tool 310 may be activated utilizing, at least in part, an intermediate completion washpipe. Other methods may also be suitable to transmit a signal to the shifting tool 310 and are considered to be included within the scope of the present disclosure.

Another signal may be transmitted from the Earth's surface through the flow control valve control line 327 to open or close the flow control valve 326 to permit or prevent pressurized fluid from flowing through a substantial portion of the internal flow passage 328 of the internal completion string 70. The flow control valve control line 327 may comprise an electrical line and/or a hydraulic line. The flow control valve 326 may be remotely operated before or after use of the shifting tool 310 to open or close the casing valve 40. For example, when the well is ready to be produced and all casing valves have been opened, the flow control valves 326 may be remotely opened to flow formation fluids to the Earth's surface.

Figure 6:
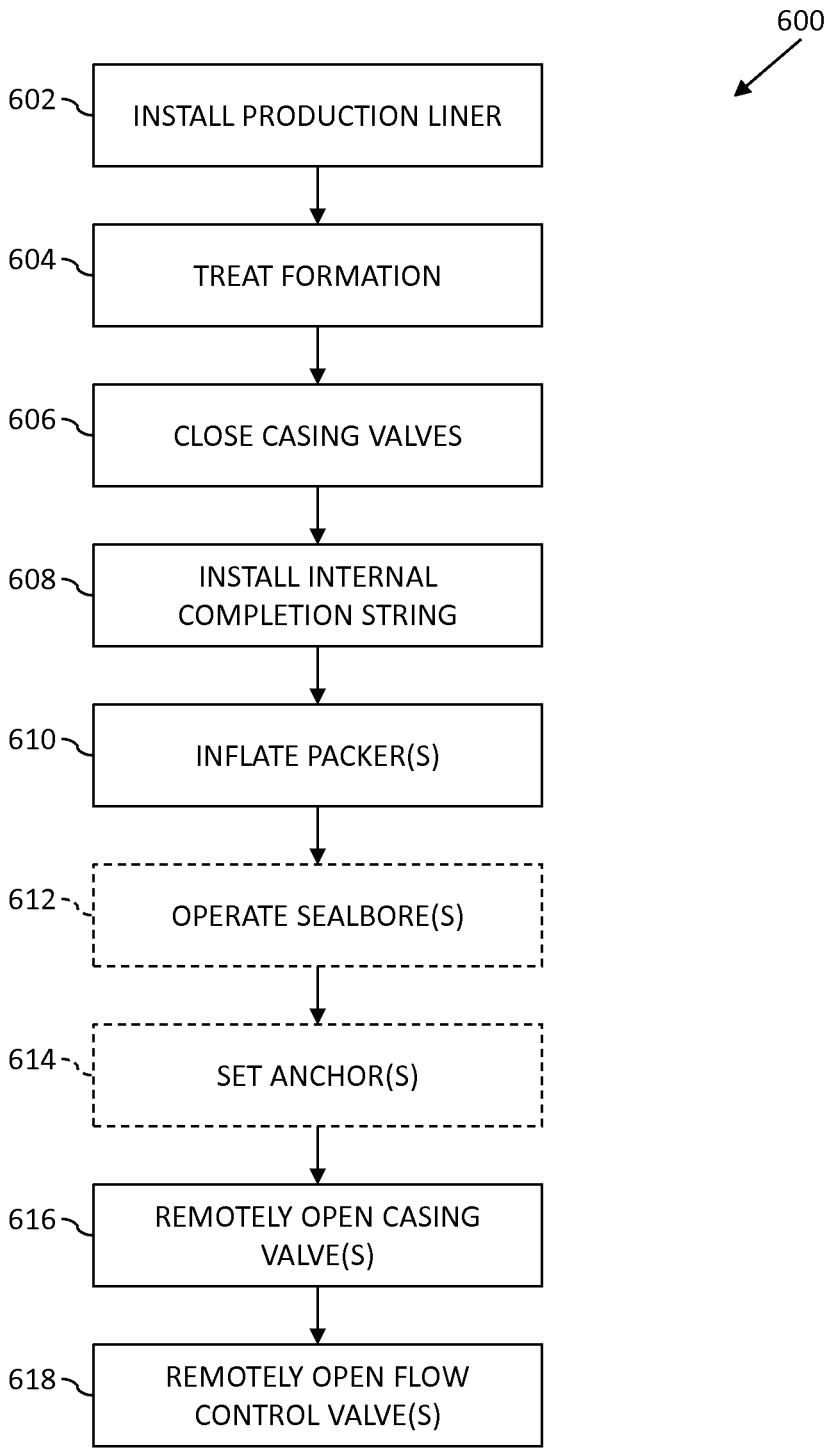
FIG. 6 is a flow-chart diagram of at least a portion of a method according to one or more aspects of the present disclosure.

FIG. 6 is a flow-chart diagram of at least a portion of a method 600 to extract formation fluids according to one or more aspects of the present disclosure. The method 600 may be executed by apparatus substantially similar to those described above or otherwise having one or more aspects in common with the apparatus described above or otherwise within the scope of the present disclosure. However, for the sake of clarity, and without limiting the scope of the method 600 or any other portion of the present disclosure, the method 600 is described below in reference to the apparatus shown in FIGS. 1-5.

Thus, referring to FIG. 6, but with continued reference to FIGS. 1-5, the method 600 comprises a step 602 during which the production liner 21 is positioned within the wellbore 20 such that the casing valves 40 and 42 connected to the production liner 21 are positioned adjacent or otherwise proximate corresponding well zones 12 and 14 within the subterranean formation 50. Cement 32 may be added between the production liner 21 and wellbore 20, as described above.

In a subsequent step 604, the well zones 12 and 14 within the subterranean formation 50 may be treated. The treating may comprise pumping slurry or other treatment fluid from the Earth's surface through the casing valves 40 and 42 and into the well zones 12 and 14 to fracture the formation, for example, although other forms of treating the well zones are also within the scope of the present disclosure. Once treatment of a well zone 12 and/or 14 is complete, the casing valves 40 and/or 42 may be closed during step 606 by sliding the moveable closure members 46 such that the sleeves 45 block the ports 60 of the casing valves 40 and/or 42.

The method 600 also comprises a step 608 that comprises conveying the internal production string 70 within the wellbore 20 until the internal production string 70 is landed within the production liner 21 such that the interface members 314 of the shifting tool 310 are positioned proximate the moveable members 46 of the casing valves 40 and 42. During subsequent step 610, the packers 324 may be inflated to seal the annulus defined by the internal completion string 70 and the production liner 21.

The method 600 may also comprise optional step 612 during which one or more sealbores may be utilized to isolate one casing valve 40 from another casing valve 42 and/or to isolate one well zone 12 from another well zone 14. One or more sealbores may also be utilized to isolate one well zone 12 from another well zone 14 when a plurality of casing valves are present for each of the respective well zones 12 and 14.

In another optional step 614, the anchors 316 within the shifting tool 310 may be remotely actuated via the shifting tool actuator control line 313, such as to expand the anchors 316 into engagement with the body of the casing valve 40. The anchors 316 may stabilize the shifting tool 313 relative to the production liner 21, although other mechanisms may also or alternatively be utilized for this purpose, if desired.

During subsequent step 616, a signal is sent from the Earth's surface via the shifting tool actuator control line 313 to remotely activate the actuator 312 of the shifting tool 310. When activated, the actuator 312 may cause the interface members 314 to move sufficiently to engage the moveable members 46 of the casing valve 40 and slide the moveable members 46 such that the ports 60 of the casing valve 40 change from being covered by the sleeves 45 to being opened with filter elements 47 in fluid communication with the ports 60. The open casing valve 40 may permit the pressurized formation fluid 52 to flow from the well zone 12 into an internal flow passage 328 of the internal completion string 70. The process of steps 614 and 616 may be repeated to open all valves 40 and 42 in the production liner 21 without repositioning the internal completion string 70.

After the casing valves 40 and 42 in the production liner 21 have been opened, a step 618 may be commenced to remotely open the flow control valves 326 via the flow control valve control line 327. Once the flow control valves 326 are open, formation fluid may flow through an internal flow passage 328 in the internal completion string 70 to the Earth's surface.

In view of the entirety of the present disclosure, including the figures, those having ordinary skill in the art should readily recognize that the present disclosure introduces apparatus and methods for extracting formation fluids from a treated subterranean formation by opening casing valves of a production liner with an internal completion string inside of the production liner. The internal completion string may comprise packers and a series of remotely actuated flow control valves and shifting tools. Multiple casing valves may be run in series to comprise the production liner. The casing valves may comprise sleeves that are operable to cover the casing valve ports in the closed position and filter elements to cover the ports when the well is on production.

To open the casing valves, shifting tools that correspond to each casing valve are incorporated within the internal completion string. For example, if there are two casing valves, the internal completion string may comprise two corresponding shifting tools positioned proximate the casing valves when the internal completion string is landed in the production liner. Each shifting tool of the internal completion string may comprise an actuator, an interface member (e.g., collet), and expandable anchors. The shifting tools also comprise an internal passage for fluid to flow inside the internal completion string.

After lowering the internal completion string to the appropriate depth within the production liner such that the packer is set above the top most casing valve, and other wellbore activities have ended, the well is ready to produce. The first shifting tool linear actuator may be activated remotely. Remote activation may be achieved through one or more hydraulic and/or electric control lines extending from the Earth's surface to the shifting tool. The shifting tool may first expand the anchors, and then an actuator of the shifting tool may be operated such that an interface member of the shifting tool engages the moveable member of the casing valve. As the shifting tool continues to be actuated, the port of the casing valve is opened and the wellbore is exposed to formation pressures and fluids. Thus, the shifting tool may open the casing valve without any mechanical movement of the internal completion string itself. The process may then be repeated for the next casing valve. After the casing valves are open, the flow control valves in the internal completion string may be remotely opened to allow formation fluid to flow to the Earth's surface.

In view of all of the above and the figures, those having ordinary skill in the art will readily recognize that the present disclosure introduces a method comprising: anchoring an internal completion string within a closed casing valve of a production liner in a wellbore that extends from the Earth's surface into a subterranean formation, wherein: the internal completion string may comprise a packer and a shifting tool; and the production liner may comprise a casing valve comprising a port and a moveable member; sealing an annulus defined between the production liner and the internal completion string; and remotely operating the shifting tool to move the moveable member away from the port, thereby opening the casing valve.

Remotely operating the shifting tool may comprise transmitting a signal via a shifting tool control line extending from the shifting tool to surface equipment at the Earth's surface. The shifting tool control line may comprise at least one of an electrical line and a hydraulic line.

Remotely operating the shifting tool may comprise transmitting an electronic signal to the shifting tool via an electrical line extending from surface equipment at the Earth's surface to the shifting tool, and transmitting a hydraulic signal to the shifting tool via fluid flowing from surface equipment at the Earth's surface to the shifting tool via an internal flow passage of the internal completion string. Transmitting an electronic signal to the shifting tool via the electrical line may further comprise transmitting the electronic signal across an inductive coupling between the electrical line and a feature of the internal completion string. The internal completion string may further comprise a flow control valve operable to interrupt fluid flow within the internal flow passage of the internal completion string, and a hydraulic wet mating operable to communicate fluid flow from surface equipment at the Earth's surface to the internal flow passage of the internal completion string.

Remotely operating the shifting tool may comprise transmitting a hydraulic signal to the shifting tool via fluid flowing from surface equipment at the Earth's surface to the shifting tool via an internal flow passage of the internal completion string, and converting the hydraulic signal received by the shifting tool into an RFID signal operable to actuate the shifting tool.

The internal completion string may further comprise an intelligent valve (e.g., an IRDV) comprising a controller, and remotely operating the shifting tool may comprise transmitting a hydraulic signal to the intelligent valve via fluid flowing from surface equipment at the Earth's surface to the intelligent valve via an internal flow passage of the internal completion string.

Remotely operating the shifting tool may comprise conveying a ball to a landing of the internal completion string via fluid flowing from surface equipment at the Earth's surface to the internal completion string via an internal flow passage of the internal completion string.

The internal completion string may further comprise an anchor, and anchoring the internal completion string may comprise remotely operating the anchor. The method may further comprise remotely operating the anchor to retract the anchor away from the production liner. Remotely operating the anchor may comprise transmitting a signal via an anchor control line extending from the anchor to surface equipment at the Earth's surface. The anchor control line may comprise at least one of an electrical line and a hydraulic line. Remotely operating the anchor may comprise expanding the anchor from the internal completion string into contact with the production liner. Expanding the anchor may comprise inflating the anchor.

The shifting tool may comprise an interface member and an actuator, and remotely operating the shifting tool may comprise remotely operating the actuator to impart linear motion to the interface member. Remotely operating the actuator may comprise transmitting a signal via a shifting tool actuator control line extending from surface equipment at the Earth's surface to the actuator. The shifting tool actuator control line may comprise at least one of an electrical line and a hydraulic line. The linear motion of the interface member may comprise linear motion sufficient to move the interface member into engagement with the moveable member of the casing valve. The linear motion of the interface member may further comprise linear motion sufficient to move the moveable member away from the port. The interface member may comprise a collet.

Remotely operating the shifting tool to move the moveable member away from the port may expose the wellbore to the formation proximate the casing valve. The moveable member may comprise an annular sleeve slidingly engaged within the casing valve. The casing valve may further comprise a moveable filter element, and remotely operating the shifting tool to shift the moveable member away from the port may comprise moving the annular sleeve away from the port and, substantially simultaneously, moving the moveable filter element towards the port. Moving the annular sleeve away from the port and moving the moveable filter element towards the port may expose the wellbore to the subterranean formation proximate the casing valve.

Sealing the annulus may comprise extending a packer from the internal completion string into sealing engagement with the production liner.

The method may not comprise moving the entire internal completion string relative to the production liner.

The casing valve may be one of a plurality of casing valves of the production liner, and the method may further comprise repeating the sealing and remotely operating steps for each of the plurality of casing valves.

The internal completion string may further comprise a flow control valve operable to interrupt fluid flow within an internal passage extending along a substantial portion of the internal completion string, and the method may further comprise remotely operating the flow control valve prior to remotely operating the shifting tool. Remotely operating the flow control valve may comprise transmitting a signal via a flow control valve control line extending from the flow control valve to surface equipment at the Earth's surface. The flow control valve control line may comprise at least one of an electrical line and a hydraulic line.

The present disclosure also introduces a method comprising: treating a subterranean formation adjacent a wellbore extending from the Earth's surface into the subterranean formation, wherein a production liner positioned in the wellbore may comprise a casing valve comprising a port and a moveable member, and wherein treating the subterranean formation may comprise pumping fluid from the Earth's surface into the subterranean formation through the port; moving the moveable member within the casing valve to block the port after treating the subterranean formation; landing an internal completion string in the production liner after moving the moveable member within the casing valve to block the port, wherein the internal completion string may comprise tubing, a packer, a flow control valve, a shifting tool comprising a linear actuator and a collet driven by the linear actuator, a first control line extending from the flow control valve to the Earth's surface, and a second control line extending from the shifting tool to the Earth's surface, wherein landing the internal completion string in the production liner may comprise positioning the internal completion string relative to the production liner such that the collet of the shifting tool engages with the moveable member; setting the packer to seal an annulus defined between the production liner and the internal completion string; expanding an anchor of the shifting tool to engage the casing valve; activating the linear actuator of the shifting tool from the Earth's surface via the second control line, thereby imparting similar linear motion to the collet and, due to the engagement of the collet with the moveable member; and opening the flow control valve from the Earth's surface via the first control line.

The present disclosure also introduces an apparatus comprising: a production liner installed within a wellbore extending from the Earth's surface into a subterranean formation, wherein the production liner may comprise a casing valve comprising: a port; and a closure member slidingly engaged within the casing valve and moveable between a closed-port position, in which the closure member interrupts fluid communication between the production liner and the subterranean formation proximate the port, and an open-port position, in which fluid communication is permitted between the production liner and the subterranean formation proximate the port; and an internal completion string installed within the production liner and comprising: an interface member operable to impart linear motion to the closure member; and an actuator operable to impart linear motion to the interface member. The apparatus may further comprise a liner hanger coupling the production liner to a casing extending along a substantial portion of the wellbore.

The casing valve may further comprise a moveable filter member slidingly engaged within the casing valve and moveable between a filtering position, in which the filter member filters fluid communication between the production liner and the subterranean formation proximate the port, and a non-filtering position, in which the filter member does not filter fluid communication between the production liner and the subterranean formation proximate the port. The moveable filter and the closure member may be integral portions of a single discrete member.

The internal completion string may further comprise a packer extendable from the internal completion string into sealing engagement with the production liner. The internal completion string may further comprise a flow control valve remotely operable to close an internal flow passage of the internal completion string. The apparatus may further comprise a control line extending from equipment at the Earth's surface to the flow control valve. The control line may comprise at least one of an electric line and a hydraulic line. The internal completion string may further comprise an anchor extendable from the internal completion string into sealing engagement with the production liner.

The actuator may be a linear actuator, a rotating actuator and/or a torsional actuator. The apparatus may further comprise a control line extending from equipment at the Earth's surface to the actuator. The control line may comprise at least one of an electric line and a hydraulic line.

The interface member may comprise a collet, and the collet and the closure member may comprise profiles that are collectively cooperative to engage upon sufficient linear motion of the collet relative to the closure member. The interface member may comprise a plurality of discrete members collectively biased to engage the closure member. The plurality of discrete members may be spring-loaded to collectively engage the closure member. The interface member may comprise a plurality of discrete members actuated hydraulically to engage the closure member. The interface member may comprise a set of slips cooperative to engage the closure member.

The production liner may be installed within the wellbore via cement disposed in an annulus defined between the circumference of the wellbore and an outer profile of the production liner.

The linear motion imparted by the interface member to the closure member, and the linear motion imparted by the actuator to the interface member, may be in a direction away from a lower end of the wellbore. The linear motion imparted by the interface member to the closure member, and the linear motion imparted by the actuator to the interface member, may be in a direction towards a lower end of the wellbore.

The apparatus may further comprise a sealbore disposed between the casing valve and a seal of the internal completion string and operable to isolate the casing valve from an additional casing valve of the internal completion string.

The casing valve may be a first casing valve disposed proximate a first production zone of the subterranean formation. The production liner may further comprise a second casing valve substantially similar to the first casing valve but disposed proximate a second production zone of the subterranean formation. The apparatus may further comprise a sealbore operable to isolate the first casing valve from the second casing valve.

The casing valve may be one of a first plurality of substantially similar casing valves comprised by the production liner and collectively disposed proximate a first production zone of the subterranean formation. The production liner may further comprise a second plurality of casing valves each substantially similar to those of the first plurality of casing valves and collectively disposed proximate a second production zone of the subterranean formation. The apparatus may further comprise a sealbore operable to isolate the first plurality of casing valves from the second plurality of casing valves.

The present disclosure also introduces a method comprising: anchoring an internal completion string within a closed casing valve of a production liner in a wellbore that extends from the Earth's surface into a subterranean formation, wherein: the internal completion string may comprise a shifting tool; and the casing valve may comprise a port and a moveable member; sealing an annulus defined between the production liner and the internal completion string; and remotely operating the shifting tool to move the moveable member away from the port, thereby opening the casing valve. Remotely operating the shifting tool may comprise at least one of: transmitting an electronic signal to the shifting tool via an electrical line extending from surface equipment at the Earth's surface to the shifting tool; and transmitting a hydraulic signal to the shifting tool via fluid flowing from surface equipment at the Earth's surface to the shifting tool via an internal flow passage of the internal completion string. The internal completion string may further comprise an anchor, and anchoring the internal completion string may comprise remotely operating the anchor. The shifting tool may comprise an interface member and an actuator, and remotely operating the shifting tool may comprise remotely operating the actuator to impart linear motion to the interface member. The linear motion of the interface member may comprise linear motion sufficient to move the interface member into engagement with the moveable member of the casing valve. The moveable member may comprise an annular sleeve, the casing valve may further comprise a moveable filter element, and remotely operating the shifting tool to shift the moveable member away from the port may comprise moving the annular sleeve away from the port and, substantially simultaneously, moving the moveable filter element towards the port. Sealing the annulus may comprise extending a packer from the internal completion string into sealing engagement with the production liner. The internal completion string may further comprise a flow control valve operable to interrupt fluid flow within an internal passage extending along a substantial portion of the internal completion string, and the method may further comprise remotely operating the flow control valve prior to remotely operating the shifting tool. The method may further comprise, before anchoring the internal completion string: treating a subterranean formation adjacent the wellbore by pumping fluid from the Earth's surface into the subterranean formation through the port; and moving the moveable member within the casing valve to block the port after treating the subterranean formation.

The present disclosure also introduces an apparatus comprising: a production liner installed within a wellbore extending from the Earth's surface into a subterranean formation, wherein the production liner may comprise a casing valve comprising a port and a closure member slidingly engaged within the casing valve and moveable between a closed-port position, in which the closure member interrupts fluid communication between the production liner and the subterranean formation proximate the port, and an open-port position, in which fluid communication is permitted between the production liner and the subterranean formation proximate the port; and an internal completion string installed within the production liner and comprising: an interface member operable to impart linear motion to the closure member; and an actuator operable to impart linear motion to the interface member. The casing valve may further comprise a moveable filter member slidingly engaged within the casing valve and moveable between a filtering position, in which the filter member filters fluid communication between the production liner and the subterranean formation proximate the port, and a non-filtering position, in which the filter member does not filter fluid communication between the production liner and the subterranean formation proximate the port. The moveable filter and the closure member may be integral portions of a single discrete member. The internal completion string may further comprise a packer extendable from the internal completion string into sealing engagement with the production liner. The internal completion string may further comprise a flow control valve remotely operable to close an internal flow passage of the internal completion string. The apparatus may further comprise a control line extending from equipment at the Earth's surface to the flow control valve, wherein the control line may comprise at least one of an electric line and a hydraulic line. The internal completion string may further comprise an anchor extendable from the internal completion string into sealing engagement with the production liner. The actuator may comprise at least one of: a linear actuator; a rotating actuator and a torsional actuator. The apparatus may further comprise a control line extending from equipment at the Earth's surface to the actuator, wherein the control line may comprise at least one of an electric line and a hydraulic line. The interface member and the closure member may comprise profiles that collectively cooperate to engage upon sufficient linear motion of the collet relative to the closure member. The casing valve may be a first casing valve disposed proximate a first production zone of the subterranean formation, and the production liner may further comprise a second casing valve substantially similar to the first casing valve but disposed proximate a second production zone of the subterranean formation.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

anchoring an internal completion string within a plurality of casing valves of a production liner in a wellbore that extends from the Earth's surface into a subterranean formation, wherein:

the internal completion string comprises a plurality of shifting tools; and each casing valve comprises a port and a movable member;

sealing an annulus defined between the production liner and the internal completion string; and remotely operating the plurality of shifting tools to selectively open or close each casing valve without mechanically moving the internal completion string to a different location in the production liner.

2. The method of claim 1 wherein remotely operating the shifting tool comprises at least one of:

transmitting an electronic signal to each shifting tool via an electrical line extending from surface equipment at the Earth's surface to the shifting tool; and transmitting a hydraulic signal to each shifting tool via fluid flowing from surface equipment at the Earth's surface to the shifting tool via an internal flow passage of the internal completion string.

3. The method of claim 1 wherein the internal completion string further comprises an anchor, and wherein anchoring the internal completion string comprises remotely operating the anchor.

4. The method of claim 1 wherein each shifting tool comprises an interface member and an actuator, and wherein remotely operating the shifting tool comprises remotely operating the actuator to impart linear motion to the interface member.

5. The method of claim 4 wherein the linear motion of the interface member comprises linear motion sufficient to move the interface member into engagement with the movable member of the casing valve.

6. The method of claim 1 wherein the movable member comprises an annular sleeve, wherein the casing valve further comprises a movable filter element, and wherein remotely operating the shifting tool to shift the movable member away from the port comprises moving the annular sleeve away from the port and, substantially simultaneously, moving the movable filter element towards the port.

7. The method of claim 1 wherein sealing the annulus comprises extending a packer from the internal completion string into sealing engagement with the production liner.

8. The method of claim 1 wherein the internal completion string further comprises a flow control valve operable to interrupt fluid flow within an internal passage extending along a substantial portion of the internal completion string, and wherein the method further comprises remotely operating the flow control valve prior to remotely operating a corresponding shifting tool.

9. The method of claim 1 further comprising, before anchoring the internal completion string:

treating a subterranean formation adjacent the wellbore by pumping fluid from the Earth's surface into the subterranean formation through the port; and moving the movable member within the casing valve to block the port after treating the subterranean formation.

* * * * *